US007929869B2

(12) United States Patent
Yasukawa et al.

(10) Patent No.: US 7,929,869 B2
(45) Date of Patent: Apr. 19, 2011

(54) SHEET FEEDER AND JAM DETECTING METHOD

(75) Inventors: Ryoichi Yasukawa, Kahoku (JP); Minoru Masuda, Kahoku (JP); Satoshi Ishida, Kahoku (JP)

(73) Assignee: PFU Limited, Kahoku (JP)

( * ) Notice: Subject to any disclaimer, the term of this patent is extended or adjusted under 35 U.S.C. 154(b) by 1026 days.

(21) Appl. No.: 11/331,078

(22) Filed: Jan. 13, 2006

(65) Prior Publication Data

US 2006/0159471 A1 Jul. 20, 2006

(30) Foreign Application Priority Data

Jan. 14, 2005 (JP) ..... P2005-007318

(51) Int. Cl.
*G03G 15/00* (2006.01)
*B65H 7/06* (2006.01)
*B65H 7/00* (2006.01)

(52) U.S. Cl. ..... 399/21; 399/9; 399/16; 399/361

(58) Field of Classification Search ..... 399/21, 399/9, 16, 361, 363–405; *B65H 7/00, 7/06; G03G 15/00*

See application file for complete search history.

(56) References Cited

U.S. PATENT DOCUMENTS

| | | | | |
|---|---|---|---|---|
| 4,332,462 | A | 6/1982 | Yagasaki et al. | |
| 4,551,813 | A | 11/1985 | Sanbayashi et al. | |
| 4,686,540 | A * | 8/1987 | Leslie et al. | 346/33 R |
| 4,937,622 | A * | 6/1990 | Makiura | 399/21 |
| 4,975,749 | A * | 12/1990 | Tsunoda et al. | 399/374 |
| 5,031,896 | A * | 7/1991 | Winkler | 271/258.04 |
| 5,232,216 | A * | 8/1993 | Bybee | 271/228 |
| 5,345,302 | A * | 9/1994 | Hamakawa | 399/86 |
| 5,615,876 | A | 4/1997 | Yergenson et al. | |
| 6,572,096 | B1 * | 6/2003 | Johnson et al. | 271/25 |
| 7,431,282 | B2 * | 10/2008 | Ohama | 271/65 |
| 2005/0123309 | A1 * | 6/2005 | Coriale et al. | 399/21 |

FOREIGN PATENT DOCUMENTS

| | | | |
|---|---|---|---|
| DE | 30 19 892 | | 11/1980 |
| DE | 32 42 428 | | 6/1983 |
| DE | 38 78 179 | | 7/1993 |
| JP | 56149932 | A * | 11/1981 |
| JP | 58097061 | A * | 6/1983 |
| JP | 63053534 | A * | 3/1988 |
| JP | 02255463 | A * | 10/1990 |
| JP | 5-132192 | | 5/1993 |
| JP | 6-191018 | | 7/1994 |
| JP | 63-53534 | | 3/1998 |

(Continued)

OTHER PUBLICATIONS

Official Translation of JP 56149932 A.*

(Continued)

*Primary Examiner* — Judy Nguyen
*Assistant Examiner* — 'Wyn' Q Ha

(57) ABSTRACT

A transporter is adapted to transport a sheet in a transport direction in a transport path that includes a detecting range. A measurer is disposed at an upstream end of the detecting range in the transport direction, and is operable to measure a moving distance of the sheet. A detector is disposed at a downstream end of the detecting range in the transport direction, and is operable to detect a leading end edge of the sheet. A processor is operable to detect a jam in case that the moving distance is longer than a distance of the detecting range in the transport direction while the leading end edge of the sheet is not detected by the detector.

4 Claims, 4 Drawing Sheets

FOREIGN PATENT DOCUMENTS

| | | |
|---|---|---|
| JP | 2000-159370 | 6/2000 |
| JP | 2001-194834 | 7/2001 |
| JP | 2004-284778 | 10/2004 |

OTHER PUBLICATIONS

U.S. Appl. No. 12/216,794, filed Jul. 10, 2008, Ryoichi Yasukawa et al., PFU Limited.

U.S. Office Action mailed Jan. 4, 2010 in related U.S. Appl. No. 12/216,794.

Japanese Office Action issued on Mar. 23, 2010 in corresponding Japanese Patent Application 2005-007318.

U.S. Office Action mailed on Jun. 9, 2010 in the related U.S. Appl. No. 12/216,794.

U.S. Office Action mailed on Oct. 8, 2010 in the related U.S. Appl. No. 12/216,794.

U.S. Office Action mailed on Jan. 21, 2011 in the related U.S. Appl. No. 12/216,794.

* cited by examiner

SHEET FEEDER AND JAM DETECTING METHOD

BACKGROUND OF THE INVENTION

The invention relates to a sheet feeder in which sheets stacked on a hopper are picked to be transported thereinto and the sheets so picked are fed thereinto sheet by sheet by a separator roller and a brake roller which are provided at a separating section, and a jam detecting method therefor.

A related sheet feeder for use with an image reader takes out sheets sheet by sheet by a configuration shown in FIG. 6. In the event that there are a plurality of sheets of document to be read, the plurality of sheets of document are piled up and set in a hopper so that end portions of the sheets so piled up are situated below a pick roller. When the pick roller rotates in such a manner as to pull the sheets so set into the feeder, a sheet existing on the top of the pile of sheets is picked by virtue of a frictional force generated at a portion thereof which comes into contact with the pick roller so as to be fed into a feeder main body. As this occurs, while there occurs a case where not only a single sheet on the top of the pile of sheets of document but also a few sheets from the top of the pile are transported at the same time, the number of sheets to be fed into the feeder is restricted by regulating the thickness of a passable sheet by a feeding gate, and furthermore, only a sheet is designed to be separated from the pile by means of a separator roller and a brake roller so as to be fed into the feeder.

In a sheet feeder like this, in order to detect a jam of a sheet, a sheet detecting sensor is provided in a sheet path existing further ahead of the separator roller, so that a jam is determined on in the event that the passage of the sheet cannot be verified even when a transport means (a roller or a belt, or a vacuum-powered transport device) is operated to produce a distance which allows the sheet to arrive at the sheet detecting sensor based on a comparison between a transport amount of the transport means and a time required for the sheet to arrive at the sheet detecting sensor (refer to JP-A-6-191018).

In addition, there is a method for detecting a jam by detecting the height of a deflected sheet when the sheet continues to be transported although a leading end thereof is stopped due to a jam (refer to U.S. Pat. No. 5,615,876).

A device adopting as a transport means a roller or a belt which make use of a frictional force of rubber or the like is adopted in most sheet feeders. In these sheet feeders, since the separating performance is satisfied by disposing a separating means (a pad and a roller, a belt and the like) in such a manner as to oppositely face a transport means for transporting sheets, a separating resistance is applied to a sheet even when only a single sheet is transported, and, depending on types of sheets and wear state of the roller, and the setting environment of the feeder, there has occurred a difference in displacement is generated due to slippage between the transport means and the sheet.

Consequently, since a delay is generated in sheet detecting time due to the difference in displacement, even when sheets are normally fed without a jam, in the above sheet feeders, a threshold of a drive amount for the transport means, which is based on which a jam is determined on at a jam detecting section has had to be increased to a level several to several tens times an actual transport distance in order not to detect a jam erroneously.

In the event that the above setting is made, however, in case a jam occurs at the sheet feeding section, since the roller is rotated several to several tens times more than the transport distance, there has been caused a problem that when the difference in displacement is small, the sheet is largely deflected and wrinkled, and is, in the worst case, broken.

SUMMARY

It is therefore an object of the invention to provide a sheet feeder which can detect a jam of a sheet at an early stage thereof so as to alleviate a damage that would be made to the sheet even in a case where the aforesaid difference in displacement is generated.

In order to achieve the object, according to the invention, there is provided a sheet feeder comprising:

a transporter, adapted to transport a sheet in a transport direction in a transport path that includes a detecting range;

a measurer, disposed at an upstream end of the detecting range in the transport direction, and operable to measure a moving distance of the sheet;

a detector, disposed at a downstream end of the detecting range in the transport direction, and operable to detect a leading end edge of the sheet; and a processor, operable to detect a jam in case that the moving distance is longer than a distance of the detecting range in the transport direction while the leading end edge of the sheet is not detected by the detector.

A picking section from which the sheet is transported in the transport path, may be disposed at an upstream side of the transport path in the transport direction, a separating section through which the sheet passes one by one, may be disposed at a downstream side of the picking section in the transport direction, and the detecting range may be located at at least one of a first location between the picking section and the separating section and a second location disposed at a downstream side of the separating section in the transport direction.

An encoder may be provided at the separating section, the encoder may be served as the detector in case that the detecting range is located at the first location, and the encoder may be served as the measurer in case that the detecting range is located at the second location.

A roller may be served as the measurer, the roller may be brought into contact with the sheet with a first pressure smaller than a second pressure that is imparted to the sheet by the transporter, and the roller may rotate while following a contact point between the sheet and the transporter, which varies depending on a dimension of the transporter, environmental temperature, and a shape of the sheet.

A roller may be served as the measurer, and be driven by the sheet that is transported by the transporter so as to rotate.

According to the invention, there is also provided a jam detecting method for a sheet feeder including a transporter adapted to transport a sheet in a transport direction in a transport path including a detecting range, the method comprising:

measuring a moving distance of the sheet at an upstream end of the detecting range;

detecting a leading end edge of the sheet at a downstream end of detecting range; and detecting a jam in case that the moving distance is longer than a distance of the detecting range in the transport direction while the leading end edge of the sheet is not detected.

According to the invention, a jam of a sheet is detected at an early stage thereof so as to alleviate a damage that would otherwise be made to the sheet even in the event that a difference in displacement is generated between the transport means and the sheet depending on types of sheets and wear state of the roller, and the setting environment of the feeder.

According to the invention, there is also provided a driven roller driven by a sheet that is transported in a first direction by a transport roller so as to rotate, the driven roller comprising:

a detector, operable to detect a leading end edge of the sheet and a rotating amount of the driven roller.

The driven roller may be disposed in the vicinity of the transport roller and be independent from the transport roller.

The driven roller may be supported in such a manner as to freely rotate around a shaft of the transporter roller and be movable in a second direction perpendicular to the first direction.

DETAIL DESCRIPTION OF PREFERRED EMBODIMENTS

Figure 1:
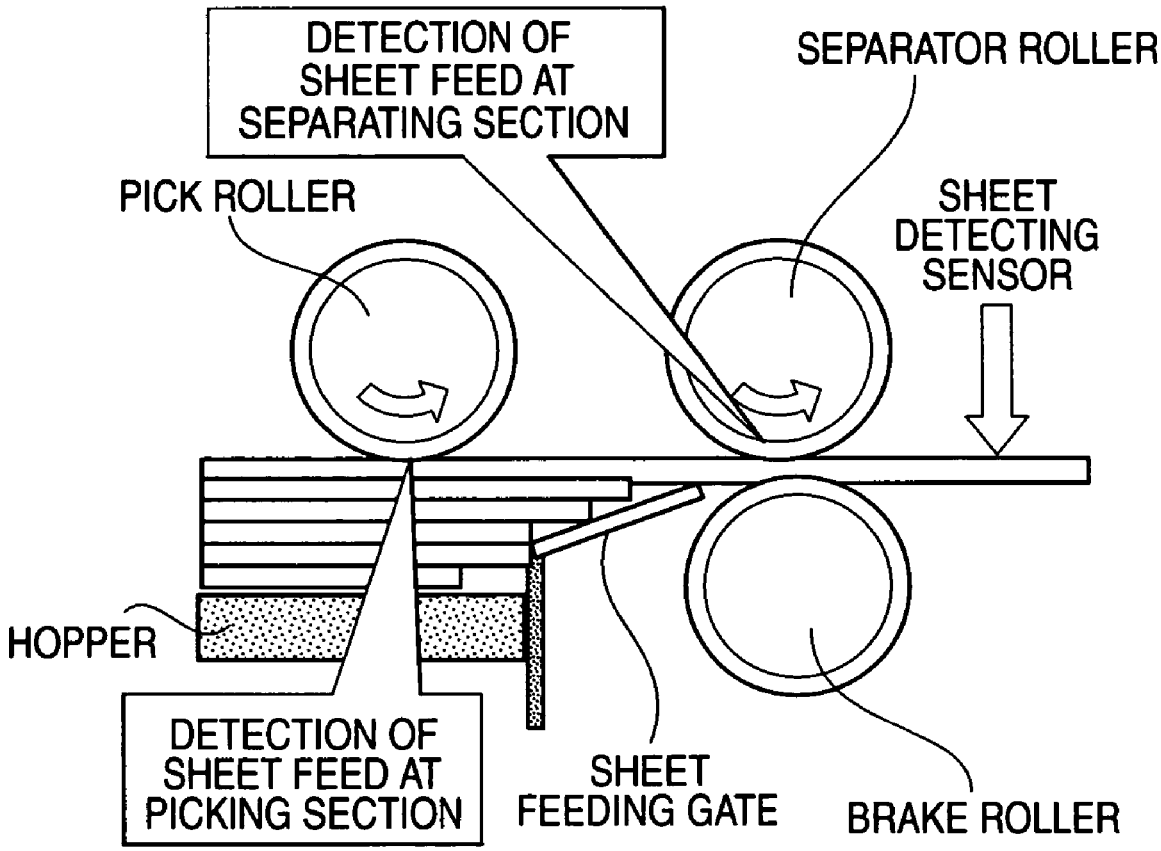
FIG. 1 is a diagram which illustrates a sheet feeder for use with an image reader.

Hereinafter, the invention will be described based on an embodiment. A sheet feeder is, for example, used in an image reader. As shown in FIG. 1, a pick roller is provided at an end portion of a hopper on which sheets are stacked so as to pick the sheets stacked on the hopper from the top thereof to transport them into the feeder. As this occurs, while there occurs a case where not only a single sheet on the top of the pile of sheets but also a few sheets from the top of the pile are transported at the same time, the number of sheets to be fed into the feeder is restricted by regulating the thickness of a passable sheet by a feeding gate, and furthermore, only a sheet is designed to be separated from the pile by means of a separator roller and a brake roller so as to be fed into the feeder.

Figure 2:
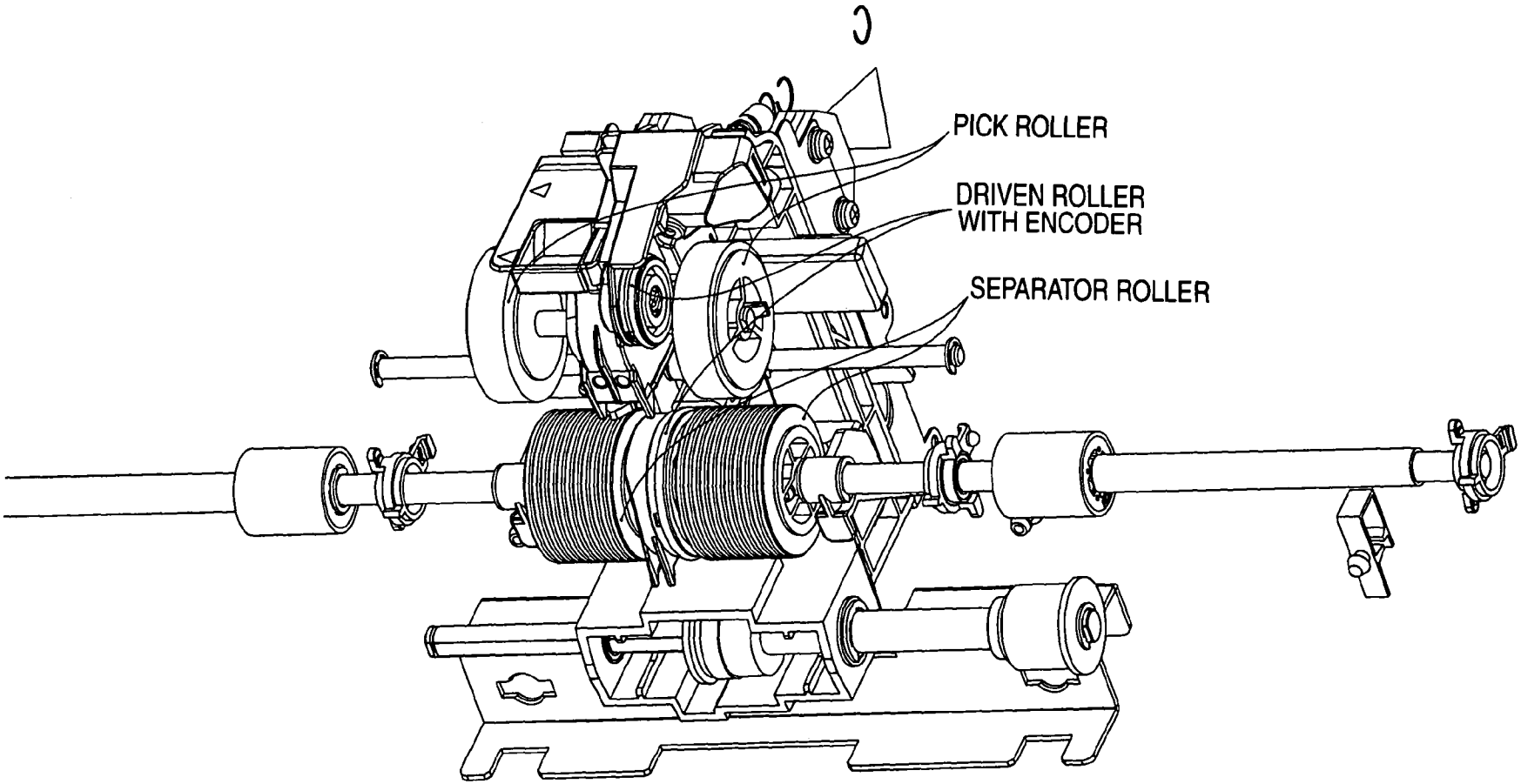
FIG. 2 is a diagram which shows a pick roller and a separator roller as viewed from a sheet contacting side.

The pick roller and the separator roller are driven by a motor. In each of a picking section and a separating section, a device which detects the speed of a sheet is provided. In each of the pick roller and the separator roller as shown in FIG. 2, two axially divided rollers are fixed on an identical drive shaft. A driven roller with an encoder is provided between the two divided rollers in such a manner as to be brought into contact with a sheet being fed so as to rotate in response to the movement of the sheet. No load is applied to these driven rollers, and the driven rollers are supported in such a manner as to freely rotate around drive shafts of the pick rollers and the separator rollers, respectively. The driven rollers are independent from the pick rollers and the separator rollers and are movable in a vertical direction so as to be brought into contact with the sheet. These driven rollers use a roller with a small rotating load which contacts a sheet with a smaller pressure than a sheet pressure that is imparted to the sheet by a transport means (the pick rollers or the separator rollers) to thereby rotate while following the sheet and rotates while following a sheet contact height (a contact point between the sheet and the transport means) which varies depending on a dimensional of the transport means, environmental temperature, and shapes of sheets. These driven rollers are driven by the sheet that is transported by the transport means.

By providing the encoder which detects the rotational speed of the driven roller, a sheet transport speed at the picking section and the separating section can be calculated from the roller rotational speed and roller diameter by a processor that is not shown in the drawings. In addition, whether or not a sheet exists at the separating section or a leading end of a sheet can be detected by whether or not the driven roller provided at the separating section rotates. Furthermore, a sensor, which normally functions as a sheet detecting sensor (as shown in FIG. 1), is provided along a sheet path ahead of the separator rollers in a sheet feeding direction. Distances between the pick rollers and the separator rollers and between the separator rollers and the sheet detecting sensor are known, and sections so defined by the rollers and the sensor constitute jam detecting ranges.

Figure 3:
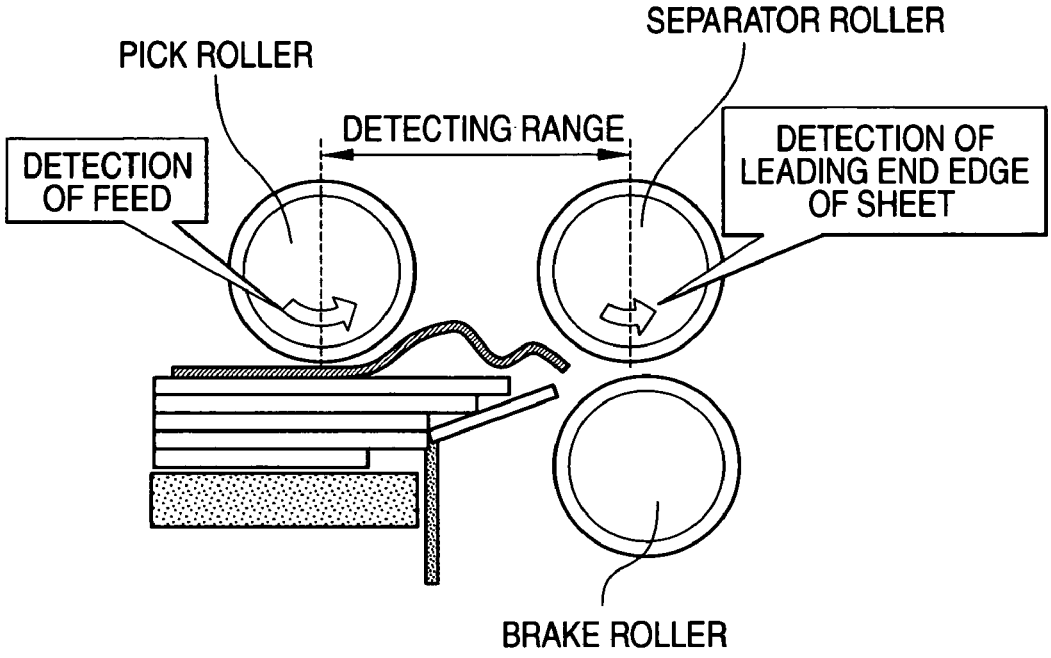
FIG. 3 is a diagram which explains a jam detection according to the invention.

FIG. 3 shows an example in which a jam is determined on after a sheet is fed further by an allowable value or more in the event that no actual arrival of the sheet at the downstream side is detected after the sheet has been fed by a distance which is estimated based on a sheet feed (an actual displacement), which is detected at the picking section, to allow the sheet to arrive at the separating section situated downstream. An actual displacement over which the sheet is transported by driving the pick roller is detected by providing the driven roller with an encoder (which can detect a rotating amount of the driven roller) at the picking section (refer to FIG. 2). A sheet displacement can be operated from a measured value of a rotating amount of the driven roller, and by monitoring the state of the sheet detecting sensor situated downstream relative to the sheet displacement so calculated, in the event that the sheet does not arrive at the sheet passage detecting sensor even after the sheet has been transported by a distance equal to the sheet displacement so calculated plus an allowable value given to a distance to the sheet passage detecting sensor or more, a jam is determined on by the processor. The driven roller with an encoder which is provided at the separating section can be made use of as a sheet passage detecting sensor at the separating section. The arrival of the leading end of the sheet can be detected by detecting that the driven roller resumes its rotation after a stopped state.

Figure 4:
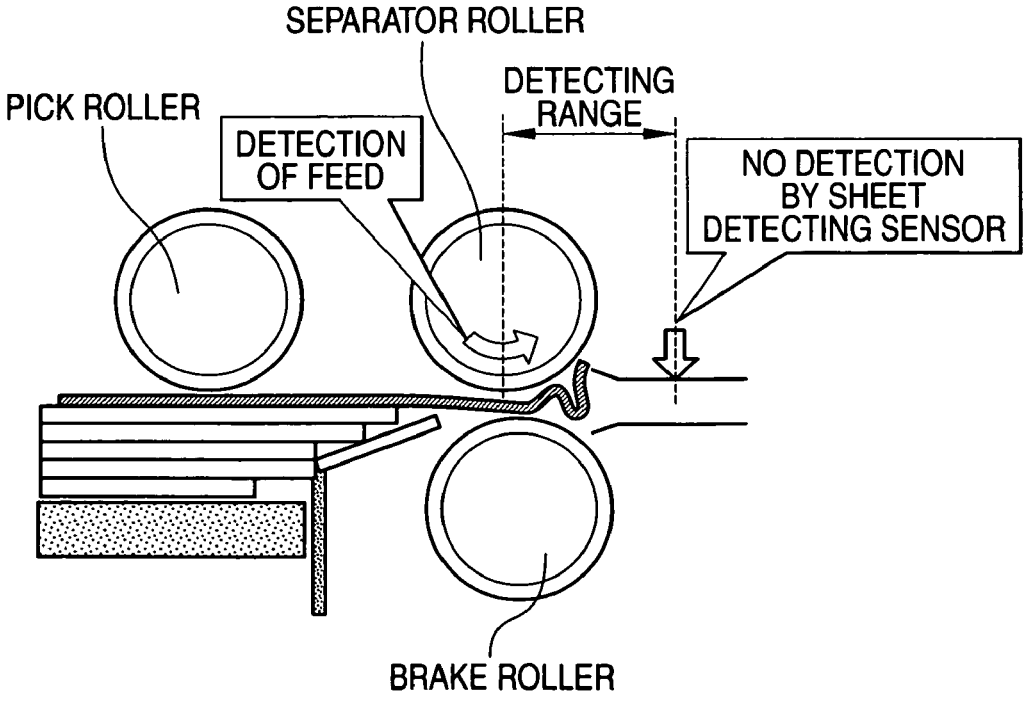
FIG. 4 is a diagram which explains another jam detection according to the invention.

FIG. 4 shows an example in which a jam is determined on after a sheet is fed further by an allowable value or more in the event that no actual arrival of the sheet at a sheet detecting sensor section situated downstream after the sheet has been fed further by a distance which is estimated based on a sheet feed (an actual displacement), which is detected at the separating section, to allow the sheet to arrive at the sheet detecting sensor portion. When the configuration shown in FIG. 4 is compared to that in FIG. 3, both the configurations are understood to function on the similar principle except for differences in the means for measuring the sheet feed and the specific means for detecting the sheet on the downstream side.

Figure 5:
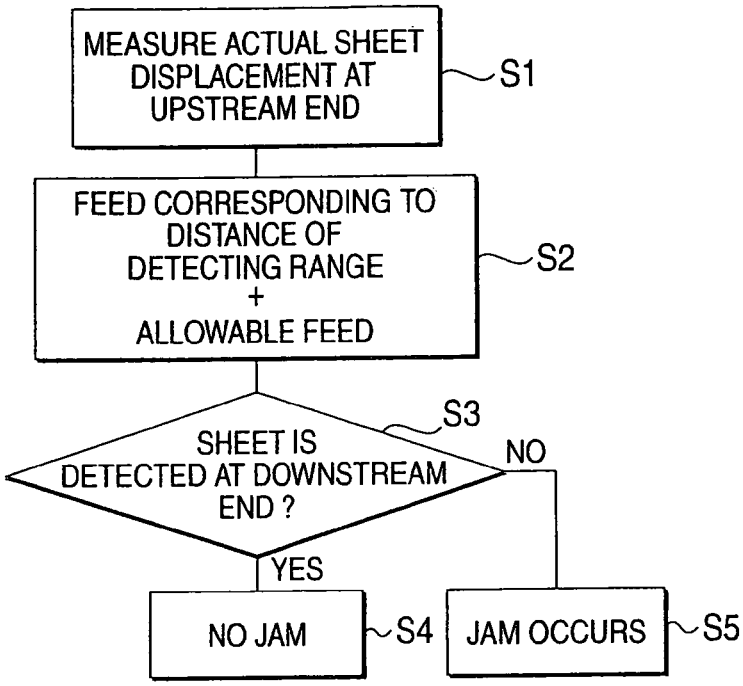
FIG. 5 is a flowchart which summarizes the jam detections according to the invention.
Figure 6:
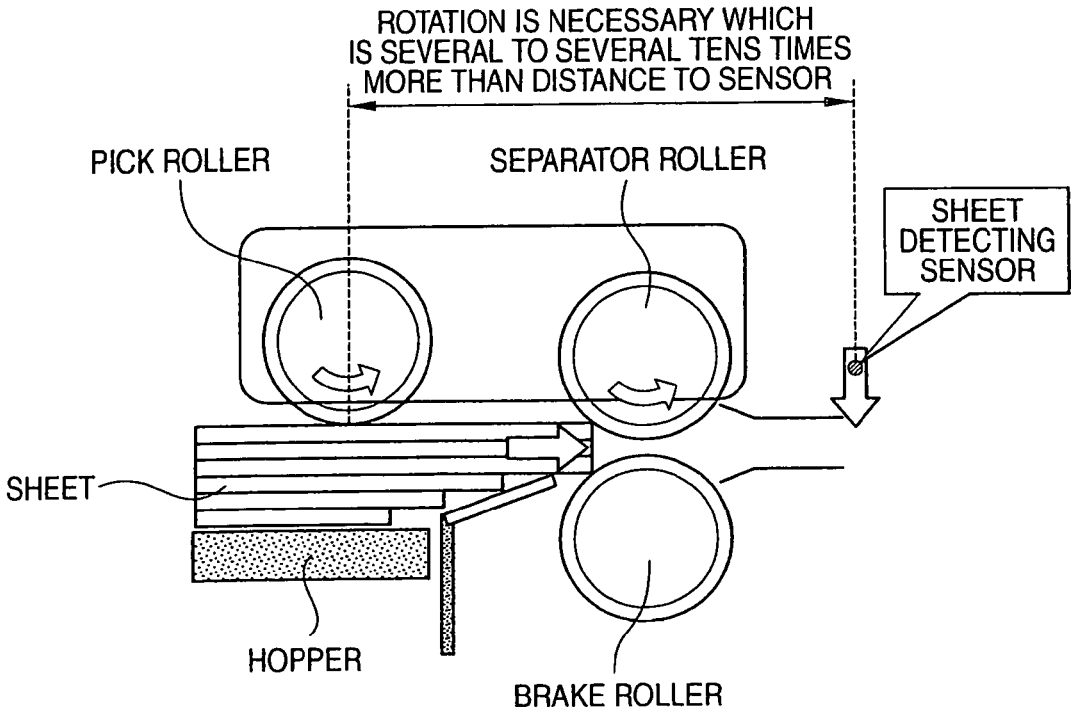
FIG. 6 PRIOR ART
FIG. 6 is a diagram which shows a related sheet feeder for use with an image reader.

As shown in FIG. 5, a sheet actual displacement is measured at the upstream end of the jam detecting range (step S1). After the sheet has been fed by an amount which corresponds to the distance of the jam detecting range based on the sheet feed so measured, the sheet is fed further by the allowable amount. (step S2). Then, whether or not an actual sheet arrival has been detected at the downstream end is determined (step S3), and if the arrival is determined to be detected, a jam is determined as not taking place (step S4), whereas, if not detected, a jam is determined as occurring (S5).

What is claimed is:

1. A sheet feeder, comprising:

a transporter, adapted to transport a sheet in a transport direction along a transport path that includes a detecting range, the detecting range including a first range and a second range disposed at a downstream side of the first range in the transport direction, the transporter including a picking section from which the sheet is transported in the transport path and that is disposed at an upstream end of the first range in the transport direction and a separating section through which the sheet passes one by one and that is disposed at an upstream end of the second range in the transport direction;

a first measurer, disposed at the picking section, and operable to measure a moving distance of the sheet while the sheet is transported by the transporter, the first measurer including a first driven roller configured to freely rotate around a common drive shaft with the picking section and to be driven by the sheet when the sheet passes the picking section;

a second measurer, disposed at the separating section, and operable to measure a moving distance of the sheet while the sheet is transported by the transporter and to detect a leading end edge of the sheet, the second measurer including a second driven roller configured to freely rotate around a common drive shaft with the separating section and to be driven by the sheet when the sheet passes the separating section;

a detector, disposed at a downstream end of the second range in the transport direction, and operable to detect the leading end edge of the sheet; and a processor, operable to detect a jam either when the moving distance of the sheet measured by the first measurer becomes longer than a length of the first range in the transport direction and the leading end edge of the sheet is not detected by the second measurer, or when the moving distance measured by the second measurer becomes longer than a length of the second range in the transport direction and the leading end edge of the sheet is not detected by the detector.

2. The sheet feeder according to claim 1, wherein each of the first and second measurers is an encoder.

3. The sheet feeder according to claim 1, wherein the first driven roller is brought into contact with the sheet with a first pressure smaller than a second pressure that is imparted to the sheet by the transporter, and the first driven roller rotates while following a contact point between the sheet and the transporter, which varies depending on a dimension of the transporter, environmental temperature, and a shape of the sheet.

4. A sheet feeder, comprising:

a transporter, adapted to transport a sheet in a transport direction along a transport path that includes a detecting range, the transporter including at least one picking roller, from which the sheet is transported in the transport path, disposed at an upstream side of the transport path in the transport direction and at least one separating roller, through which the sheet passes one by one, disposed at a downstream side of the at least one picking roller in the transport direction;

a first driven roller configured to freely rotate around a common drive shaft with the at least one picking roller and disposed at an upstream end of the detecting range in the transport direction, the first driven roller being configured to be driven by the sheet and including a measurer operable to measure a moving distance of the sheet while the sheet is transported by the transporter, the measurer being independent from the transporter to measure the moving distance of the sheet;

a second driven roller configured to freely rotate around a common drive shaft with the at least one separating roller, the second driven roller being configured to be driven by the sheet when the sheet passes the separating roller;

a detector, disposed at a downstream end of the detecting range in the transport direction, and operable to detect a leading end edge of the sheet; and a processor, operable to detect a jam either when the moving distance of the sheet becomes longer than a length of the detecting range in the transport direction and the second driven roller is not being driven, or when the moving distance of the sheet becomes longer than a length of the detecting range in the transport direction and the leading end edge of the sheet is not detected by the detector.

* * * * *